US007014187B2

(12) United States Patent
Mayerberg, II et al.

(10) Patent No.: US 7,014,187 B2
(45) Date of Patent: Mar. 21, 2006

(54) VACUUM PLENUM SYSTEM FOR FACILITATING THE HIGH-SPEED CONVEYANCE OF MAIL PIECES

(75) Inventors: Willson L. Mayerberg, II, Skiatook, OK (US); Joe C. Bollinger, Tulsa, OK (US); Jack E. Olson, Tulsa, OK (US)

(73) Assignee: Lockheed Martin Corporation, Bethesda, MD (US)

( * ) Notice: Subject to any disclaimer, the term of this patent is extended or adjusted under 35 U.S.C. 154(b) by 170 days.

(21) Appl. No.: 10/459,613

(22) Filed: Jun. 12, 2003

(65) Prior Publication Data

US 2004/0251606 A1 Dec. 16, 2004

(51) Int. Cl.
*B65H 29/32* (2006.01)

(52) U.S. Cl. ..... 271/197; 271/276; 271/3.22; 271/196

(58) Field of Classification Search ..... 271/275, 271/276, 3.22, 69, 196, 197; 198/626.1, 198/689.1
See application file for complete search history.

(56) References Cited

U.S. PATENT DOCUMENTS 3,796,424 A * 3/1974 Fox ..... 271/1
4,314,696 A 2/1982 Graef
5,192,066 A 3/1993 Steinhilber
5,499,809 A 3/1996 Takemoto et al.
5,564,693 A * 10/1996 Elkis et al. ..... 271/276
5,676,368 A 10/1997 Wilson et al.
6,494,452 B1 * 12/2002 Karasiewicz ..... 271/276

FOREIGN PATENT DOCUMENTS

JP 05286628 A * 11/1993

* cited by examiner

*Primary Examiner*—Donald P. Walsh
*Assistant Examiner*—Kaitlin Joerger
(74) *Attorney, Agent, or Firm*—Schwartz & Weinrieb

(57) ABSTRACT

A new and improved article or mail-piece conveyor system has a vacuum plenum system integrally incorporated therein which effectively withdraws ambient air ahead or downstream of the oncoming conveyed articles or mail pieces such that the oncoming conveyed articles or mail pieces will not be subjected to tip vortices and/or other disruptive aerodynamic forces. In this manner, the articles or mail pieces will not be subjected to destabilizing aerodynamic circulation, currents, downflow, downwash, or momentum forces so as not to, in turn, exhibit flutter, fluctuations, or oscillation movements. Accordingly, extremely high speed conveyance of the articles or mail pieces, within the range of, for example, two hundred inches per second (200 ips) can in fact be achieved.

34 Claims, 3 Drawing Sheets

14a
16
28
4
4
56
52
66
42
48
VG
54
58
30
18
50
40

28
3
14a
CBFP
16
12a
42
60
14a-i
24
36
30
18
64
46
14c
20
32
12c
3
14b
14c-i
38
26
12b
62
44
14b-i
10
40
22
34
CBFP

VACUUM PLENUM SYSTEM FOR FACILITATING THE HIGH-SPEED CONVEYANCE OF MAIL PIECES

FIELD OF THE INVENTION

The present invention relates generally to article or mail-piece conveyor systems, and more particularly to a new and improved vacuum plenum system, for use in conjunction with the conveyor belts of an article or mail-piece conveyor system, wherein inner runs or inner portions of oppositely disposed, endless, looped conveyor belts cooperate together so as to convey articles or mail pieces therebetween and along the longitudinal extent of the conveyor system, and wherein further, as a result of the employment of such a vacuum plenum system within the article or mail-piece conveyor system, the air, disposed ahead or downstream of the articles or mail pieces, is effectively removed from the article or mail-piece conveyor path so as to effectively eliminate the development, generation, or presence of destabilizing circulation forces, momentum vectors, and tip vortices, whereby the conveyor belts are effectively able to be driven at a substantially high rate of speed without the articles or mail pieces experiencing flutter or oscillation which would otherwise deleteriously affect, and cause disintegration of, the articles or mail pieces, being conveyed by means of the article or mail-piece conveyor system, as a result of, for example, frictional forces generated or developed between each one of the oppositely disposed, inner runs or inner portions of the endless, looped conveyor belts and the respective side surfaces of each article or mail piece being conveyed by means of the oppositely disposed, inner runs or inner portions of the endless, looped conveyor belts of the article or mail-piece conveyor system.

BACKGROUND OF THE INVENTION

Article conveyor systems conventionally comprise serially arranged pairs of conveyor belts for conveying the particular articles in a predetermined direction. Each one of the conveyor belts comprises a closed or endless loop structure wherein opposite ends of the closed or endless loop are respectively routed around rollers, at least one of which comprises a conveyor belt drive roller. The inner runs or inner portions of each pair of closed or endless looped conveyor belts are disposed immediately adjacent to each other in an opposed, side-by-side, or laterally or transversely spaced, mode with respect to each other along the direction of conveyance. In this manner, the opposed inner runs or inner portions of the conveyor belts cooperate together so as to effectively encounter and operatively engage the articles therebetween whereby the articles are effectively entrained with the opposed conveyor belts so as to be conveyed thereby in the predetermined direction of conveyance. The drive roller operatively associated with each conveyor belt is conventionally driven by means of a drive system which comprises, for example, a high-voltage electric drive motor and a mechanical drive system operatively interconnecting the electric motor output shaft and the rotary drive shaft upon which the drive roller is fixedly mounted. Such mechanical drive systems generate and radiate an inordinate amount of noise. In addition, while the electric drive motors, respectively associated with each one of the conveyor belts comprising each pair of oppositely disposed conveyor belts, can be suitably regulated so as to cause their output shafts to be rotated at a predetermined rotary speed which would, in turn, cause the conveyor belt drive rollers to likewise be rotated at the same rotary speed, due to various factors inherently characteristic of conventional conveyor belt drive systems, it often happens that the opposed conveyor belts are not in fact driven at the same lineal rate of speed.

Accordingly, a speed differential effectively exists between the oppositely disposed inner runs or inner portions of the opposed conveyor belts, and when these oppositely disposed inner runs or inner portions of the opposed conveyor belts, being operated at their different lineal rates of speed, operatively engage the opposite surface portions of the articles being conveyed between and by the oppositely disposed inner runs or inner portions of the opposed conveyor belts, serious operational and environmental problems occur. More particularly, as a result of the engagement of the opposite surface portions of the articles by the oppositely disposed inner runs or inner portions of the opposed conveyor belts conveying the articles along the longitudinal extent of the overall conveyor system, frictional forces are generated between the opposite surface portions of the articles and the oppositely disposed inner runs or inner portions of the opposed conveyor belts as a result of the effective mechanical scrubbing of the opposite surface portions of the articles by the oppositely disposed inner runs or inner portions of the opposed conveyor belts. In light of such mechanical scrubbing of the opposite surface portions of the articles by the oppositely disposed inner runs or inner portions of the opposed conveyor belts, the articles being conveyed by the opposed conveyor belts are subjected to highly erosive forces. These highly erosive forces not only effectively compromise the structural integrity of each article being conveyed by the opposed conveyor belts, but in addition, result in the generation of atmospherically suspended cellulose particulates which not only constitute a human health hazard but, still further, present a potentially explosive atmospheric condition and hazardous work environment.

Continuing still further, it is noted, particularly in those conveying systems wherein the articles, such as, for example, mail pieces, are desirably conveyed, or sought to be conveyed, at substantially high rates of speed, such as, for example, within the range of two hundred inches per second (200 ips), that the articles or mail pieces are effectively the aerodynamic equivalent of a flat plate. As such, the articles or mail pieces will be subjected to aerodynamic forces which can be significantly disruptive to the stable conveyance of the articles or mail pieces when the articles or mail pieces are in fact conveyed at the afore-noted desirable high rates of speed within such article or mail piece conveying systems. More particularly, the air flows or air currents within such article or mail piece conveying systems are not always uniform or precisely symmetric with respect to the longitudinal axis of the conveyance path along which the articles or mail pieces are being conveyed. In addition, surface imperfections or irregularities may be present upon the conveyor belts. Still yet further, due to the airflows past the articles or mail pieces, which are structurally equivalent to a finite wing or airfoil, air circulation, currents, downflow, downwash, and momentum forces result in the generation of tip vortices. These various forces and vortices cause the articles or mail pieces to undergo or exhibit destabilizing fluctuation, flutter, or oscillatory movements which also contribute to the development of mechanical or structural interaction or engagement between the articles or mail pieces and the conveyor belts.

This dynamic situation again results in frictional forces being generated between the opposite surface portions of the articles or mail pieces and the oppositely disposed inner runs or inner portions of the opposed conveyor belts whereby mechanical scrubbing of the opposite surface portions of the articles or mail pieces, by the oppositely disposed inner runs or inner portions of the opposed conveyor belts, effectively occurs. In turn, the articles or mail pieces being conveyed and mechanically scrubbed by the oppositely disposed conveyor belts are subjected to highly erosive forces whereby, again, such highly erosive forces not only effectively compromise the structural integrity of each article or mail piece being conveyed by the oppositely disposed conveyor belts, but in addition, result in the generation of atmospherically suspended cellulose particulates which not only constitute a human health hazard but, in addition, present a potentially explosive atmospheric condition and hazardous work environment.

A need therefore exists in the art for a new and improved article or mail-piece conveyor belt drive system, wherein oppositely disposed, inner runs or inner portions of the endless looped conveyor belts can cooperate together so as to convey articles or mail pieces along the longitudinal extent of the conveyor system at a substantially high rate of speed and in a stabilized manner, wherein the articles or mail pieces will not be subjected to aerodynamic forces which can be significantly disruptive to the stable conveyance of the articles or mail pieces when the articles or mail pieces are in fact conveyed at substantially high rates of speed within such article or mail piece conveying systems, and wherein the article or mail pieces, which simulate finite wing or air foil structures, will not be subjected to destabilizing air circulation, currents, downflow, downwash, or momentum forces such that tip vortices will not be generated whereby the articles or mail pieces will not undergo or exhibit fluctuation, flutter, or oscillation movements so as to effectively prevent the development of mechanical or structural interaction or engagement between the articles or mail pieces and the oppositely disposed, inner runs or inner portions of the conveyor belts whereby, in turn, frictional forces will be prevented from being generated between the opposite surface portions of the articles or mail pieces and the oppositely disposed inner runs or inner portions of the opposed conveyor belts whereby mechanical scrubbing of the opposite surface portions of the articles or mail pieces, by the oppositely disposed inner runs or inner portions of the opposed conveyor belts, will likewise be prevented from occurring so as to, in turn, effectively prevent the articles or mail pieces from being subjected to highly erosive forces which would not only effectively compromise the structural integrity of each article or mail piece being conveyed by the oppositely disposed conveyor belts, but in addition, would result in the generation of atmospherically suspended cellulose particulates which would not only constitute a human health hazard but, in addition, would present a potentially explosive atmospheric condition and hazardous work environment.

OBJECTS OF THE INVENTION

Accordingly, it is an object of the present invention to provide a new and improved plenum system, for use in conjunction with the oppositely disposed conveyor belts of an article-handling conveyor system, such as, for example, a mail-handling conveyor system, so as to facilitate the operation of the mail-handling conveyor system at substantially high rates of speed.

Another object of the present invention is to provide a new and improved plenum system, for use in conjunction with the oppositely disposed conveyor belts of an article-handling conveyor system, such as, for example, a mail-handling conveyor system, so as to facilitate the operation of the mail-handling conveyor system at substantially high rates of speed, and wherein, in particular, the new and improved plenum system effectively overcomes the various operational and environmental drawbacks and disadvantages characteristic of conventional PRIOR ART oppositely disposed conveyor belt drive systems.

An additional object of the present invention is to provide a new and improved plenum system, for use in conjunction with the oppositely disposed conveyor belts of an article-handling conveyor system, such as, for example, a mail-handling conveyor system, so as to facilitate the operation of the mail-handling conveyor system at substantially high rates of speed, and wherein, in particular, the new and improved plenum system effectively withdraws the air ahead or downstream of the mail pieces being conveyed by the mail-handling conveyor system such that the mail pieces will not be subjected to destabilizing aerodynamic circulation, currents, downflow, downwash, or momentum forces so as to, in turn, prevent the generation of tip vortices which could otherwise cause the articles or mail pieces to undergo or exhibit destabilizing fluctuation, flutter, or oscillation movements.

A further object of the present invention is to provide a new and improved plenum system, for use in conjunction with the oppositely disposed conveyor belts of an article-handling conveyor system, such as, for example, a mail-handling conveyor system, so as to facilitate the operation of the mail-handling conveyor system at substantially high rates of speed, and wherein, in particular, the new and improved plenum system effectively withdraws the air ahead or downstream of the mail pieces being conveyed by the mail-handling conveyor system such that the mail pieces will not be subjected to destabilizing aerodynamic circulation, currents, downflow, downwash, or momentum forces so as to, in turn, prevent the generation of tip vortices which could otherwise cause the articles or mail pieces to undergo or exhibit destabilizing fluctuation, flutter, or oscillation movements whereby the articles or mail pieces would otherwise deleteriously operatively or structurally interact with or engage the oppositely disposed inner runs or inner portions of the opposed conveyor belts.

A last object of the present invention is to provide a new and improved plenum system, for use in conjunction with the oppositely disposed conveyor belts of an article-handling conveyor system, such as, for example, a mail-handling conveyor system, so as to facilitate the operation of the mail-handling conveyor system at substantially high rates of speed, and wherein, in particular, the new and improved plenum system effectively withdraws the air ahead or downstream of the mail pieces being conveyed by the mail-handling conveyor system such that the mail pieces will not be subjected to destabilizing aerodynamic circulation, currents, downflow, downwash, or momentum forces so as to, in turn, prevent the generation of tip vortices whereby the articles or mail pieces will not undergo or exhibit destabilizing fluctuation, flutter, or oscillation movements and thereby will not operatively or structurally interact with or engage the oppositely disposed inner runs or inner portions of the opposed conveyor belts so as to prevent frictional forces from being generated between the opposite surface portions of the articles or mail pieces and the oppositely disposed inner runs or inner portions of the opposed conveyor belts whereby mechanical scrubbing of the opposite surface portions of the articles or mail pieces, by the oppositely disposed inner runs or inner portions of the opposed conveyor belts, will likewise not occur so as to, in turn, effectively prevent the articles or mail pieces from being subjected to highly erosive forces which would otherwise not only effectively compromise the structural integrity of each article or mail piece being conveyed by the oppositely disposed conveyor belts, but in addition, would result in the generation of atmospherically suspended cellulose particulates which not only constitute a human health hazard but, in addition, present a potentially explosive atmospheric condition and hazardous work environment.

SUMMARY OF THE INVENTION

The foregoing and other objectives are achieved in accordance with the teachings and principles of the present invention through the provision of a new and improved plenum system for use in conjunction with the conveyor belts of a mail-handling conveyor system which comprises a plurality of conveyor belts having endless loop configurations, wherein the conveyor belts are arranged in pairs such that inner runs or inner portions of the looped conveyor belts are disposed opposite, and in substantial contact with, each other so as to be capable of cooperating together for conveying articles therebetween along the entire longitudinal extent of the conveyor system. Opposite longitudinal end portions of each looped conveyor belt are respectively routed around a pair of drive rollers, and the pair of drive rollers may have fluid-driven impeller or turbine assemblies operatively associated therewith so as to ensure the fact that the oppositely disposed conveyor belts are operated at substantially the same rate of speed with substantially no speed differential therebetween. In accordance with the unique and novel structural components of the present invention, plenum chambers are respectively disposed interiorly within each one of the endless looped conveyor belts, and are adapted to impress vacuum suction forces upon the inner runs or inner portions of the oppositely disposed conveyor belts so as to effectively remove ambient air from the conveyance path defined or interposed between the inner runs or inner portions of the oppositely disposed conveyor belts.

In this manner, it can be appreciated that when the articles or mail pieces are in fact conveyed along the conveyance path, the ambient air has in effect already been removed ahead or downstream of the oncoming conveyed articles or mail pieces, and prior to their arrival at any particular location along the conveyance path. Accordingly, as the articles or mail pieces are conveyed along the conveyance path by means of the oppositely disposed paired conveyor belt system, the articles or mail pieces will not encounter any significant amounts of ambient air whereby the articles or mail pieces will not be subjected to destabilizing aerodynamic circulation, currents, downflow, downwash, or momentum forces such that, in turn, tip vortices are effectively prevented from being developed or, considered alternatively, any tip vortices which may have been developed will be effectively removed by means of the vacuum plenum chambers. Therefore, since the tip vortices have been effectively prevented from being generated, or have been effectively removed, the articles or mail pieces will not undergo or exhibit destabilizing fluctuation, flutter, or oscillation movements so as to not operatively or structurally interact with or engage the oppositely disposed inner runs or inner portions of the opposed conveyor belts.

In this manner, the generation of frictional forces, between the opposite surface portions of the articles or mail pieces and the oppositely disposed inner runs or inner portions of the opposed conveyor belts, are effectively prevented whereby mechanical scrubbing of the opposite surface portions of the articles or mail pieces, by the oppositely disposed inner runs or inner portions of the opposed conveyor belts, will not occur so as to, in turn, effectively prevent the articles or mail pieces from being subjected to highly erosive forces which would otherwise not only effectively compromise the structural integrity of each article or mail piece being conveyed by the oppositely disposed conveyor belts, but in addition, would result in the generation of atmospherically suspended cellulose particulates which not only constitute a human health hazard but, in addition, present a potentially explosive atmospheric condition and hazardous work environment. As a result of the incorporation of the new and improved plenum chamber system, constructed in accordance with the principles and teachings of the present invention, into the oppositely disposed paired conveyor belt system, the articles or mail pieces will be effectively conveyed at an aerodynamically center along the longitudinal axis of the conveyor belt system, and in addition, the articles or mail pieces are able to be conveyed between the oppositely disposed conveyor belts at extremely high rates of speed, such as, for example, within the range of two hundred inches per second (200 ips).

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
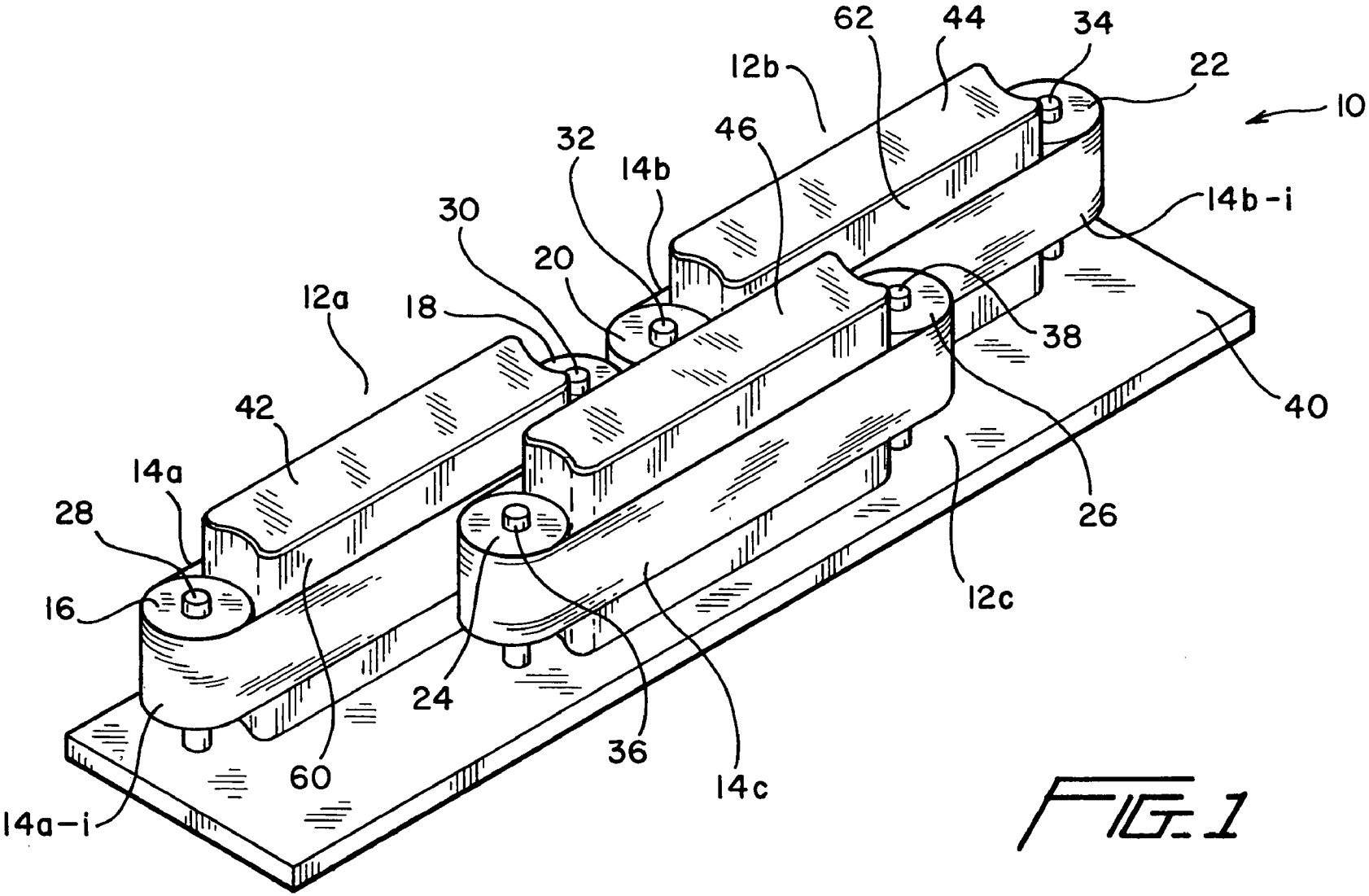
FIG. 1 is a perspective view of a new and improved article or mail-piece conveyor system constructed in accordance with the principles and teachings of the present invention and comprising a plurality of sets of oppositely disposed paired conveyor belts within which the new and improved plenum chamber systems, also constructed in accordance with the principles and teachings of the present invention, are operatively incorporated.
Figure 2:
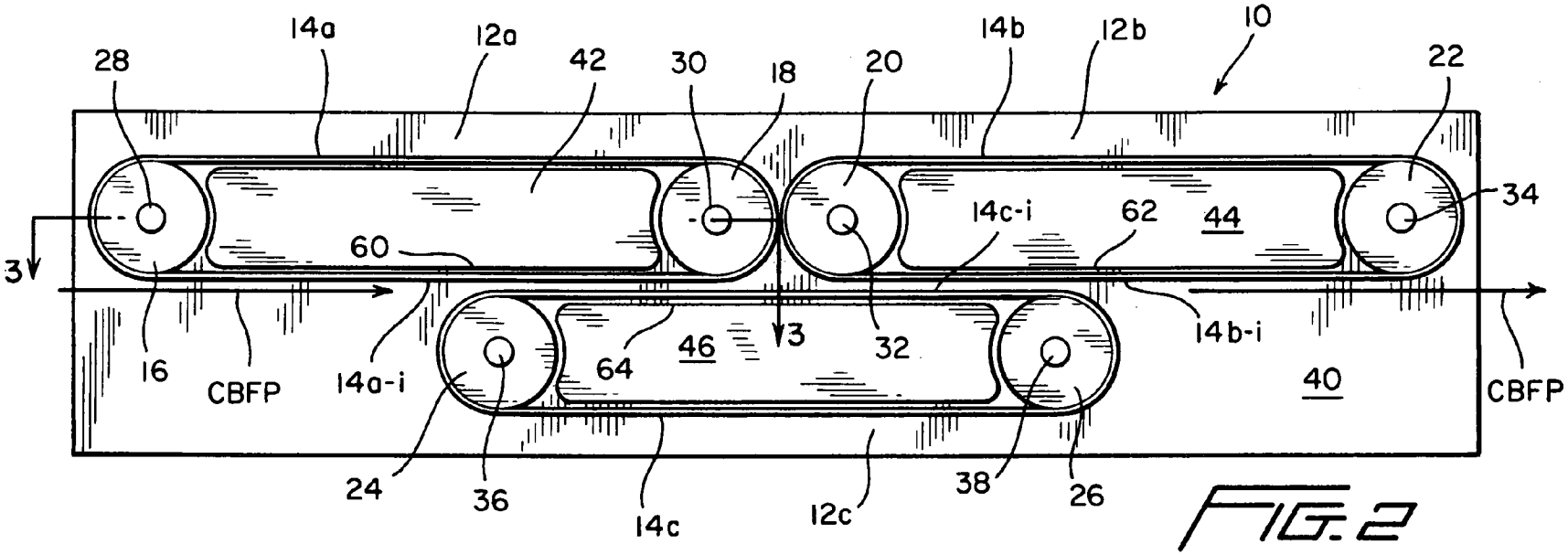
FIG. 2 is a top plan view of the new. and improved article or mail-piece conveyor system, having the new and improved plenum chamber systems operatively incorporated therein, as disclosed within FIG. 1.

Referring now to the drawings, and more particularly, initially, to FIGS. 1 and 2 thereof, there is disclosed a new and improved article or mail-piece conveyor system which has been constructed in accordance with the principles and teachings of the present invention and which is generally indicated by the reference character 10. As can readily be appreciated, the new and improved mail-piece or article conveyor system 10 is seen to comprise a plurality of oppositely disposed conveyor belt sub-systems, only three of which are disclosed, for example, at 12*a*,12*b*,12*c*, which are disposed along the longitudinally extending conveyor belt flow path CP. In particular, it is appreciated that the conveyor belt sub-systems 12*a*,12*b*,12*c* are disposed within longitudinally aligned arrays upon the same side of the longitudinally extending conveyor belt flow path CBFP, however, the conveyor belt sub-systems 12*a*,12*b*,12*c* are also disposed within a longitudinally staggered array with respect to corresponding conveyor belt sub-systems 12*a*, 12*b*,12*c* disposed upon opposite sides of the conveyor belt flow path CBFP such that each one of the conveyor belt sub-systems 12*a*,12*b*,12*c*, disposed upon a particular side of the conveyor belt flow path CBFP, effectively overlaps a pair of conveyor belt sub-systems 12*a*,12*b*,12*c* disposed upon the opposite side of the conveyor belt flow path CBFP. In this manner, the conveyor belt sub-systems 12*a*,12*b*,12*c* effectively define a conveyor belt flow path CBFP which has no substantial longitudinal spaces or gaps defined between successive ones of the conveyor belt sub-systems 12*a*,12*b*, 12*c* whereby the conveyor belt flow path CBFP is rendered substantially continuous.

Continuing further, it is seen that each one of the conveyor belt sub-systems 12*a*,12*b*,12*c* comprises an endless loop conveyor belt 14*a*,14*b*,14*c* wherein the opposite ends of each endless loop conveyor belt 14*a*,14*b*,14*c* are respectively disposed around a pair of drive rollers 16 and 18,20 and 22, and 24 and 26. The drive rollers 16,18,20,22, 24,26 are respectively mounted upon upstanding drive shafts 28,30,32,34,36,38, and the upstanding drive shafts 28,30,32, 34,36,38 are all adapted to have their lower end portions rotatably mounted within a support surface or platform 40. While the drive rollers 16,18,20,22,24,26 may be driven by conventional drive means, not shown, they are preferably of the fluid-driven type as fully disclosed within the United States Patent application entitled HYDRAULIC DRIVE SYSTEM FOR ARTICLE CONVEYOR SYSTEM, which was filed on Feb. 24, 2003, which has been assigned Ser. No. 10/370,482, and which is incorporated herein by reference.

In this manner., as has been more fully disclosed within the aforenoted United States Patent application, the oppositely disposed conveyor belts, that is, for example, conveyor belts 14*a* and 14*b*, as considered with respect to conveyor belt 14*c*, are all able to be operatively driven at the same conveying speed whereby a speed differential will not exist between the oppositely disposed inner sections or inner run portions 14*a-i*,14*b-i*,14*c-i* of the oppositely disposed conveyor belts 14*a*,14*b*,14*c*. Accordingly, frictional or scrubbing forces are not normally generated between any of the inner run portions 14*a-i*,14*b-i*,14*c-i* of the oppositely disposed conveyor belts 14*a*,14*b*,14*c* and the opposite side surface portions of the articles or mail pieces being conveyed by means of the conveyor belts 14*a*,14*b*,14*c* so as not to, in turn, adversely affect the structural integrity of the conveyed articles or mail pieces. In this manner, the gradual and partial disintegration of the conveyed articles or mail pieces is effectively prevented so as not to cause cellulosic particles to be generated and expelled into the ambient atmosphere. Such particles can create a health hazard to operator personnel, as well as the fact that they can create a potentially explosive atmosphere within the work-place.

Figure 3:
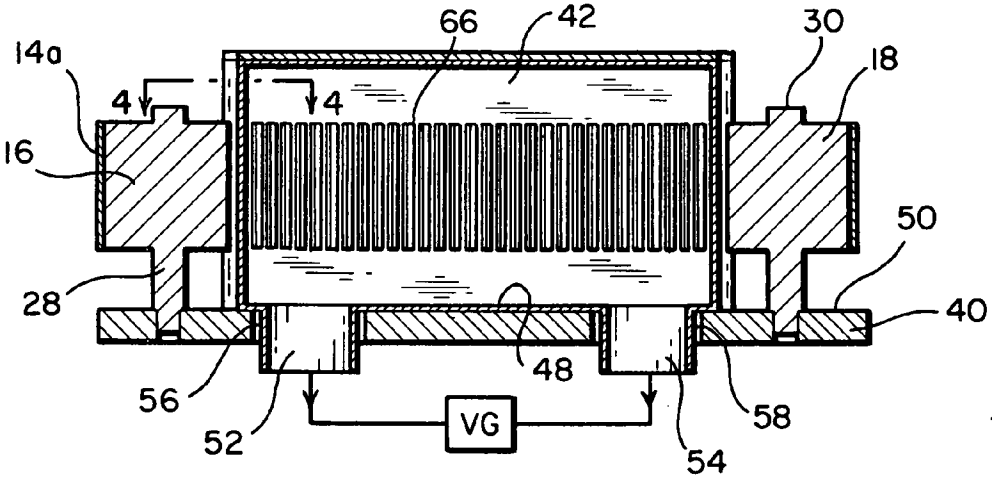
FIG. 3 is a cross-sectional view of the new and improved article or mail-piece conveyor system, having the new and improved plenum chamber systems operatively incorporated therein, as shown in FIG. 2 and as taken along line 3—3 of FIG. 2.
Figure 4:
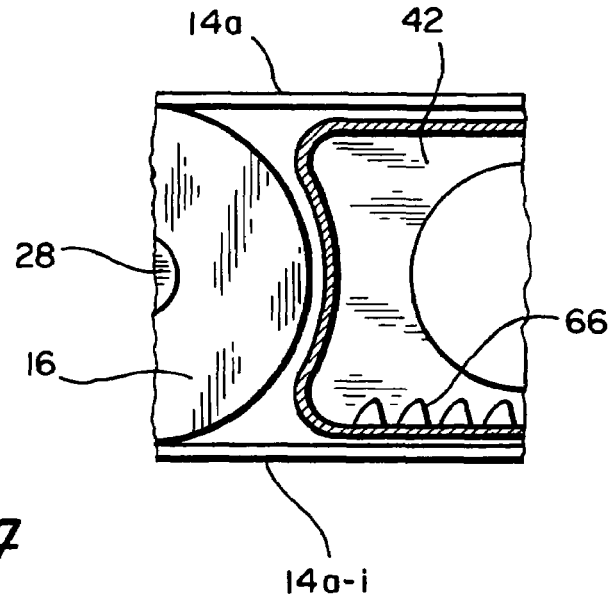
FIG. 4 is a partial cross-sectional view of the new and improved article or mail-piece conveyor system, having the new and improved plenum chamber systems operatively incorporated therein, as shown within FIG. 3 and as taken along line 4–4 of FIG. 3.
Figure 5:
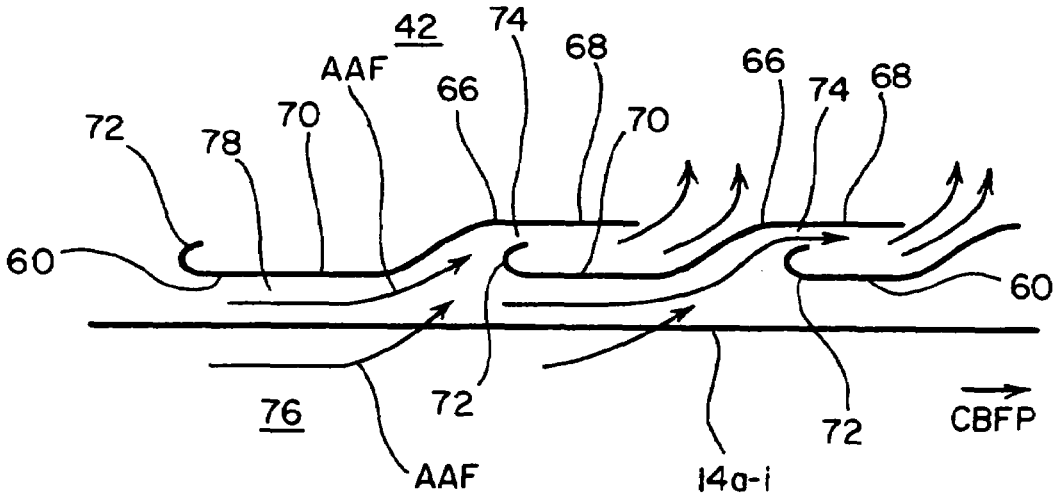
FIG. 5 is a schematic view of a specific structural arrangement of the louvers integrally incorporated within each one of the new and improved plenum chamber systems constructed in accordance with the teachings and principles of the present invention, and in particular, disclosing the air flow paths around and through the louvers for facilitating the withdrawal of the ambient air from the conveyance space, defined between the pair of oppositely disposed inner runs or inner portions of the opposed conveyor belts, and through the inner runs or inner portions of the opposed conveyor belts.

With additional reference now being made to FIGS. 3–5, and in accordance with the unique novel teachings of the new and improved article or mail-piece conveyor system 10, which has been constructed in accordance with the principles and teachings of the present invention, it is seen that a plurality of vacuum plenum chambers 42,44,46 are respectively associated with each one of the endless loop article or mail-piece conveyor belts 14*a*,14*b*,14*c*, and in particular, the vacuum plenum chambers 42,44,46 are respectively disposed within the interior spaces defined within or bounded by the endless loop conveyor belts 14*a*,14*b*,14*c*. More particularly, as can best be appreciated from FIG. 3, and with the vacuum plenum chamber 42 being exemplary of all of the vacuum plenum chambers 42,44,46, the base or bottom wall 48 of the vacuum plenum chamber 42 is seated upon the upper face or wall 50 of the support surface or platform 40, and the base or bottom wall 48 of the vacuum plenum chamber 42 is seen to further comprise a pair of vacuum plenum ports 52,54 which depend downwardly therefrom so as to be capable of passing through suitable apertures 56,58 which are formed within the support surface or platform 40. In this manner, when the vacuum plenum ports 52,54 are fluidically connected to an external vacuum source or vacuum generator VG, vacuum conditions will prevail within the interior portion or space of the vacuum plenum chamber 42. It is noted that an external vacuum source or vacuum generator VG may be provided for each one of the vacuum plenum chambers 42,44,46, or alternatively, all of the vacuum plenum chambers 42,44,46 may be fluidically connected to a single vacuum source or vacuum generator VG, or alternatively still further, groups of the vacuum plenum chambers, comprising a predetermined number of the vacuum plenum chambers 42,44,46 may be fluidically connected to a single vacuum source or vacuum generator VG.

Continuing still further, and as can best be seen from FIGS. 3–5, the inner wall member 60,62,64 of each vacuum plenum chamber 42,44,46, that is, those wall members which are respectively disposed immediately adjacent to the inner sections or inner runs 14*a-i*,14*b-i*,14*c-i* of the endless loop conveyor belts 14*a*,14*b*,14*c*, is provided with a plurality of arrayed louvers 66 through which ambient air from the longitudinally extending conveyor belt flow path CBFP can be withdrawn by means of the vacuum generator VG. It is noted that the louvers 66 are only schematically shown in FIG. 4, however, a specific structural arrangement of the louvers 66 is in fact clearly illustrated within FIG. 5. It is to be noted further that not only is the ambient air, which is present between, for example, each one of the inner sections or inner runs 14*a-i*,14*b-i*,14*c-i* of the endless loop conveyor belts 14*a*,14*b*,14*c* and the inner wall members 60,62,64, able to be sucked into the vacuum plenum chambers 42,44,46 and accordingly exhausted, but in addition, and even more importantly, the ambient air, which is present along the conveyor belt flow path CBFP and interposed between the oppositely disposed inner sections or inner runs 14*a-i*,14*b-i*,14*c-i* of the endless loop conveyor belts 14*a*,14*b*,14*c*, is likewise able to be sucked into the vacuum plenum chambers 42,44,46 and accordingly exhausted as a result of such air being capable of traversing or passing through each one of the inner sections or inner runs 14*a-i*, 14*b-i*,14*c-i* of the endless loop conveyor belts 14*a*,14*b*,14*c*in view of the fact that the endless loop conveyor belts 14*a*,14*b*,14*c* are permeable or pervious to air flow there-through. This vacuum exhaust processing of the ambient air, from its disposition along the conveyor belt flow path CBFP and interposed between the oppositely disposed inner sections or inner runs 14*a-i*,14*b-i*,14*c-i* of the endless loop conveyor belts 14*a*, 14*b*,14*c*, is critically important to the successful operation of the new and improved article or mail-piece conveyor system 10 as a high speed conveyor system which is capable of achieving enhanced conveying speeds of approximately two hundred inches per second (200 ips).

It will be recalled that, particularly in those conveying systems wherein the articles or mail pieces are desirably conveyed, or sought to be conveyed, at substantially high rates of speed, such as, for example, within the range of two hundred inches per second (200 ips), that the articles or mail pieces are effectively the aerodynamic equivalent of a flat plate. As such, the articles or mail pieces will be subjected to aerodynamic forces which can be significantly disruptive to the stable conveyance of the articles or mail pieces when the articles or mail pieces are in fact conveyed at the aforenoted desirable high rates of speed within such article or mail piece conveying systems. More particularly, the air flows or air currents within such article or mail piece conveying systems are not always uniform or precisely symmetric with respect to the longitudinal axis of the conveyance path along which the articles or mail pieces are being conveyed. In addition, surface imperfections or irregularities may be present upon the conveyor belts.

Still yet further, due to the airflows past the articles or mail pieces, which are structurally equivalent to a finite wing or airfoil, air circulation, currents, downflow, downwash, and momentum forces result in the generation of tip vortices. These various forces and vortices can normally cause the articles or mail pieces to undergo or exhibit destabilizing fluctuation, flutter, or oscillatory movements which will contribute to the development of mechanical or structural interaction or engagement between the articles or mail pieces and the conveyor belts. This dynamic situation again results in the generation of frictional forces between the opposite surface portions of the articles or mail pieces and the oppositely disposed inner runs or inner portions of the opposed conveyor belts whereby mechanical scrubbing of the opposite surface portions of the articles or mail pieces, by the oppositely disposed inner runs or inner portions of the opposed conveyor belts, effectively occurs. In turn, the articles or mail pieces being conveyed and mechanically scrubbed by the oppositely disposed conveyor belts are subjected to highly erosive forces whereby, again, such highly erosive forces will not only effectively compromise the structural integrity of each article or mail piece being conveyed by the oppositely disposed conveyor belts, but in addition, will result in the generation of atmospherically suspended cellulose particulates which not only constitute a human health hazard but, in addition, present a potentially explosive atmospheric condition and hazardous work environment.

Therefore, in accordance with the unique and novel structural components of the present invention, the plenum chambers 42,44,46 are respectively disposed interiorly within each one of the endless looped conveyor belts 14*a*, 14*b*, 14*c*, and are adapted to impress vacuum suction forces upon the inner runs or inner portions 14*a-i*,14*b-i*,14*c-i* of the oppositely disposed conveyor belts 14*a*,14*b*,14*c* so as to effectively remove the ambient air from the conveyor belt flow path CBFP defined or interposed between the inner runs or inner portions 14*a-i*,14*b-i*,14*c-i* of the oppositely disposed conveyor belts 14*a*,14*b*,14*c*. In this manner, it can be appreciated that when the articles or mail pieces are in fact conveyed along the conveyor belt flow path CBFP, the ambient air has in effect already been removed ahead or downstream of the oncoming conveyed articles or mail pieces, and prior to their arrival at any particular location along the conveyor belt flow path CBFP. Accordingly, as the articles or mail pieces are conveyed along the conveyor belt flow path CBFP by means of the oppositely disposed paired conveyor belts 14*a*,14*b*,14*c*, the articles or mail pieces will not encounter any significant amounts of ambient air whereby the articles or mail pieces will not be subjected to destabilizing aerodynamic circulation, currents, downflow, downwash, or momentum forces such that, in turn, tip vortices are effectively prevented from being developed, or considered alternatively, any tip vortices, which would normally have been developed, will have effectively been removed by means of the vacuum plenum chambers 42,44, 46. Therefore, since the tip vortices have been effectively prevented from being generated, or have been effectively removed, the articles or mail pieces will not undergo or exhibit destabilizing fluctuation, flutter, or oscillation movements so as to not operatively or structurally interact with or engage the oppositely disposed inner runs or inner portions 14*a-i*,14*b-i*, 14*c-i* of the opposed conveyor belts 14*a*,14*b*, 14*c*.

In this manner, the generation of frictional forces, between the opposite surface portions of the articles or mail pieces and the oppositely disposed inner runs or inner portions 14*a-i*,14*b-i*,14*c-i* of the opposed conveyor belts 14*a*,14*b*,14*c* are effectively prevented whereby mechanical scrubbing of the opposite surface portions of the articles or mail pieces, by the oppositely disposed inner runs or inner portions 14*a-i*,14*b-i*,14*c-i* of the opposed conveyor belts 14*a*,14*b*,14*c*, will not occur so as to, in turn, effectively prevent the articles or mail pieces from being subjected to highly erosive forces which would otherwise not only effectively compromise the structural integrity of each article or mail piece being conveyed by the oppositely disposed conveyor belts 14*a*,14*b*,14*c*, but in addition, would result in the generation of atmospherically suspended cellulose particulates which not only constitute a human health hazard but, in addition, present a potentially explosive atmospheric condition and hazardous work environment. It is additionally noted that as a result of the incorporation of the new and improved plenum chamber system 42,44,46, constructed in accordance with the principles and teachings of the present invention, into the oppositely disposed paired conveyor belt system 10, the articles or mail pieces will be effectively conveyed at an aerodynamically center along the longitudinal axis of the conveyor belt flow path CBFP, and in addition, the articles or mail pieces are able to be conveyed between the oppositely disposed conveyor belts at extremely high rates of speed, such as, for example, within the range of two hundred inches per second (200 ips).

Lastly, with reference being specifically made to FIG. 5, the particular structural arrangement of the plurality of louvers 66 formed within each one of the vacuum plenum chambers 42,44,46, and longitudinally spaced with respect to each other along the conveyor belt flow path CBFP, is disclosed. While the structural arrangement of the plurality of longitudinally spaced louvers 66 is noted as being applicable to all of the vacuum plenum chambers 42,44,46, the structural arrangement of the louvers 66, as illustrated in FIG. 5, is disclosed only in connection with the vacuum plenum chamber 42 for clarity and brevity purposes. More particularly, the plurality of longitudinally spaced louvers 66 are integrally formed as component parts of the inner wall member 60 of the vacuum plenum chamber 42, and it is seen that the plurality of longitudinally spaced louvers 66 have a substantially elongated S-shaped configuration whereby the plurality of louvers 66 are disposed in a staggered array so as to effectively overlap each other as considered in the longitudinal direction defined by means of the conveyor belt flow path CBFP.

More specifically, it is seen, for example, that a downstream portion 68 of each louver 66 is effectively transversely offset relative to the upstream portion 70 of each louver 66, as considered with respect to the longitudinal direction defined by means of the conveyor belt flow path CBFP, so as to be disposed at a position which is more internal within the vacuum plenum chamber 42 than the upstream portion 70 of each louver 66 which actually forms the inner wall member 60 of the vacuum plenum chamber 42. The upstream end of each upstream portion 70 of each louver 66 is also provided with a radiused tip 72 which is disposed relatively close to the downstream portion 68 of each louver 66 in view of the aforenoted staggered, overlapped relationship defined between the downstream and upstream portions 68,70 of the louvers 66.

In this manner, venturi regions 74 are effectively formed within each section of the louver structure defined by means of the fluidically cooperative pairs of overlapped louver sections 68,70. Accordingly, the venturi regions 74 cause the air flow therethrough to exhibit increased velocity and decreased pressure characteristics so as to facilitate the ambient air flow AAF, from both the region 76 defined, for example, between the oppositely disposed inner runs 14*a-i*,14*c-i* of the conveyor belts 14*a*,14*c*, as well as the region 78 defined between the inner run 14*a-i* of the conveyor belt 14*a* and the front wall member 60 of the vacuum plenum chamber 42, to be exhausted through the internal region of the vacuum plenum chamber 42 in accordance with the fluidic motive forces generated by means of the vacuum generator VG.

Thus, it may be seen that in accordance with the principles and teachings of the present invention, there has been provided a new and improved article or mail-piece conveyor system which has integrally incorporated therein a vacuum plenum system which effectively withdraws ambient air ahead or downstream of the oncoming conveyed articles or mail pieces such that the oncoming conveyed articles or mail pieces will not be subjected to tip vortices and/or other disruptive aerodynamic forces. In this manner, the articles or mail pieces will not be subjected to destabilizing aerodynamic circulation, currents, downflow, downwash, or momentum forces so as not to, in turn, exhibit flutter, fluctuations, or oscillation movements. Accordingly, the extremely high speed conveyance of the articles or mail pieces, within the range of, for example, two hundred inches per second (200 ips) can in fact be achieved.

It is lastly noted that, in light of the foregoing disclosure, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A plenum system, for use in conjunction with a conveyor belt system comprising a plurality of oppositely disposed conveyor belts which are disposed upon opposite sides of a conveyor belt flow path along which articles are to be conveyed, comprising:

vacuum means, operatively associated with the conveyor belt flow path, for simultaneously withdrawing ambient air, present along the conveyor belt flow path along which the articles are to be conveyed by the plurality of oppositely disposed conveyor belts, in opposite directions from the conveyor belt flow path so as to prevent the generation of tip vortices upon the articles, when the articles are conveyed along the conveyor belt flow path, such that destabilizing forces, normally resulting from the generation of the tip vortices, are not impressed upon the articles being conveyed along the conveyor belt flow path, whereby the articles are able to be conveyed along the conveyor belt flow path at an enhanced rate of speed.

2. The plenum system as set forth in claim 1, wherein:

said vacuum means comprises a plurality of vacuum plenum chambers.

3. The plenum system as set forth in claim 1, wherein:

said vacuum means comprises a plurality of vacuum plenum chambers which are disposed upon opposite sides of the conveyor belt flow path so as to remove the ambient air in opposite directions from the conveyor belt flow path such that the articles are able to be conveyed in a substantially stable manner and at a substantially aerodynamically central position with respect to the conveyor belt flow path.

4. The plenum system as set forth in claim 2, wherein:

said plurality of vacuum plenum chambers are respectively operatively associated with each one of the plurality of oppositely disposed conveyor belts.

5. The plenum system as set forth in claim 2, wherein said vacuum means further comprises:

vacuum generating means fluidically connected to each one of said plurality of vacuum plenum chambers for generating vacuum conditions internally within each one of said plurality of vacuum plenum chambers.

6. The plenum system as set forth in claim 5, wherein said vacuum generating means comprises:

a vacuum generator fluidically connected to each one of said vacuum plenum chambers.

7. The plenum system as set forth in claim 5, wherein said vacuum generating means comprises:

a vacuum generator fluidically connected to a group of said vacuum plenum chambers.

8. The plenum system as set forth in claim 2, wherein:

each one of said vacuum plenum chambers comprises an inner wall member having a plurality of louvers integrally formed therein for permitting ambient air, present along the conveyor belt flow path, to be withdrawn from the conveyor belt flow path and into said vacuum plenum chamber.

9. The plenum system as set forth in claim 8, wherein:

said plurality of louvers are disposed within a staggered, overlapped array along the conveyor belt flow path.

10. The plenum system as set forth in claim 9, wherein:

said plurality of staggered, overlapped louvers define venturi regions therebetween so as to facilitate the withdrawal of the ambient air from the conveyor belt flow path.

11. An article conveyor system, comprising:

a plurality of oppositely disposed conveyor belts which are disposed upon opposite sides of a conveyor belt flow path along which articles are to be conveyed; and vacuum means, operatively associated with said conveyor belt flow path, for simultaneously withdrawing ambient air, present along said conveyor belt flow path along which the articles are to be conveyed by said plurality of oppositely disposed conveyor belts, in opposite directions from said conveyor belt flow path so as to prevent the generation of tip vortices upon the articles, when the articles are conveyed along said conveyor belt flow path, such that destabilizing forces, normally resulting from the generation of the tip vortices, are not impressed upon the articles being conveyed along said conveyor belt flow path, whereby the articles are able to be conveyed along said conveyor belt flow path at an enhanced rate of speed.

12. The article conveyor system as set forth in claim 11, wherein:

said vacuum means comprises a plurality of vacuum plenum chambers.

13. The article conveyor system as set forth in claim 11, wherein:

said vacuum means comprises a plurality of vacuum plenum chambers which are disposed upon opposite sides of said conveyor belt flow path so as to remove the ambient air in opposite directions from said conveyor belt flow path such that the articles are able to be conveyed in a substantially stable manner and at a substantially aerodynamically central position with respect to the conveyor belt flow path.

14. The article conveyor system as set forth in claim 12, wherein:

said plurality of vacuum plenum chambers are respectively operatively associated with each one of said plurality of oppositely disposed conveyor belts.

15. The article conveyor system as set forth in claim 12, wherein said vacuum means further comprises:

vacuum generating means fluidically connected to each one of said plurality of vacuum plenum chambers for generating vacuum conditions internally within each one of said plurality of vacuum plenum chambers.

16. The article conveyor system as set forth in claim 15, wherein said vacuum generating means comprises:

a vacuum generator fluidically connected to each one of said vacuum plenum chambers.

17. The article conveyor system as set forth in claim 15, wherein said vacuum generating means comprises:

a vacuum generator fluidically connected to a group of said vacuum plenum chambers.

18. The article conveyor system as set forth in claim 12, wherein:

each one of said vacuum plenum chambers comprises an inner wall member having a plurality of louvers integrally formed therein for permitting ambient air, present along the conveyor belt flow path, to be withdrawn from the conveyor belt flow path and into said vacuum plenum chamber.

19. The article conveyor system as set forth in claim 18, wherein:

said plurality of louvers are disposed within a staggered, overlapped array along the conveyor belt flow path.

20. The article conveyor system as set forth in claim 19, wherein:

said plurality of staggered, overlapped louvers define venturi regions therebetween so as to facilitate the withdrawal of the ambient air from the conveyor belt flow path.

21. The article conveyor system as set forth in claim 15, wherein:

each one of said plurality of oppositely disposed conveyor belts has an endless loop configuration such that inner run portions of said plurality of oppositely disposed conveyor belts are disposed opposite to each other upon opposite sides of said conveyor belt flow path; and said plurality of vacuum plenum chambers are respectively disposed interiorly within each one of said plurality of oppositely disposed endless loop conveyor belts so as to withdraw the ambient air through each one of said oppositely disposed inner run portions of said plurality of oppositely disposed conveyor belts.

22. The article conveyor system as set forth in claim 21, wherein:

said plurality of oppositely disposed endless loop conveyor belts, and said plurality of vacuum plenum chambers respectively disposed interiorly within each one of said plurality of oppositely disposed endless loop conveyor belts, are disposed in a staggered, longitudinally offset array along said conveyor belt flow path.

23. The article conveyor system as set forth in claim 21, wherein: p1 each one of said endless loop conveyor belts is disposed around a pair of longitudinally spaced fluidically driven drive rollers such that said plurality of oppositely disposed endless loop conveyor belts are driven at substantially the same synchronized rate of speed so as to eliminate any speed differential therebetween.

24. A method of conveying articles along a conveyor belt flow path, defined between a plurality of oppositely disposed conveyor belts, at an enhanced rate of speed, comprising the steps of:

providing a plurality of oppositely disposed conveyor belts so as to define a conveyor belt flow path therebetween; and simultaneously withdrawing ambient air, present along said conveyor belt flow path along which the articles are to be conveyed by said plurality of oppositely disposed conveyor belts, in opposite directions from said conveyor belt flow path so as to prevent the generation of tip vortices upon the articles, when the articles are conveyed along said conveyor belt flow path by said plurality of oppositely disposed conveyor belts, such that destabilizing forces, normally resulting from the generation of the tip vortices, are not impressed upon the articles being conveyed along said conveyor belt flow path, whereby the articles are able to be conveyed along said conveyor belt flow path at an enhanced rate of speed.

25. The method of conveying articles along the conveyor belt flow path as set forth in claim 24, further comprising the steps of:

using a vacuum generator to withdraw said ambient air from said conveyor belt flow path; and fluidically connecting said vacuum generator to a plurality of vacuum plenum chambers which are fluidically connected to said conveyor belt flow path.

26. The method of conveying articles along the conveyor belt flow path as set forth in claim 25, further comprising the step of:

positioning said plurality of vacuum plenum chambers upon opposite sides of the conveyor belt flow path so as to remove the ambient air in opposite directions from the conveyor belt flow path such that the articles are able to be conveyed at a substantially aerodynamically central position with respect to the conveyor belt flow path.

27. The method of conveying articles along the conveyor belt flow path as set forth in claim 25, further comprising the step of:

fluidically connecting said plurality of vacuum plenum chambers to each one of the plurality of oppositely disposed conveyor belts so as to withdraw the ambient air, from said conveyor belt flow path, through said plurality of oppositely disposed conveyor belts.

28. The method of conveying articles along the conveyor belt flow path as set forth in claim 25, further comprising the step of:

fluidically connecting a vacuum generator to each one of said plurality of vacuum plenum chambers for generating vacuum conditions internally within each one of said plurality of vacuum plenum chambers.

29. The method of conveying articles along the conveyor belt flow path as set forth in claim 25, further comprising the step of:

providing each one of said vacuum plenum chambers with an inner wall member having a plurality of louvers integrally formed therein for permitting ambient air, present along the conveyor belt flow path, to be withdrawn from the conveyor belt flow path and into said vacuum plenum chamber.

30. The method of conveying articles along the conveyor belt flow path as set forth in claim 29, further comprising the step of:

arranging said plurality of louvers within a staggered, overlapped array along the conveyor belt flow path such that venturi regions are defined therebetween so as to facilitate the withdrawal of the ambient air from the conveyor belt flow path.

31. The method of conveying articles along the conveyor belt flow path as set forth in claim 25, further comprising the steps of:

providing each one of said plurality of oppositely disposed conveyor belts as an endless loop conveyor belt such that inner run portions of said plurality of oppositely disposed conveyor belts are disposed opposite to each other upon opposite sides of said conveyor belt flow path; and positioning said plurality of vacuum plenum chambers respectively interiorly within each one of said plurality of oppositely disposed endless loop conveyor belts so as to withdraw the ambient air through each one of said oppositely disposed inner run portions of said plurality of oppositely disposed conveyor belts.

32. The method of conveying articles along the conveyor belt flow path as set forth in claim 31, further comprising the step of:

routing each one of said endless loop conveyor belts around a pair of longitudinally spaced fluidically driven drive rollers such that said plurality of oppositely disposed endless loop conveyor belts are driven at substantially the same synchronized rate of speed so as to eliminate any speed differential therebetween.

33. The method of conveying articles along the conveyor belt flow path as set forth in claim 31, further comprising the step of:

arranging said plurality of oppositely disposed endless loop conveyor belts, and said plurality of vacuum plenum chambers respectively disposed interiorly within each one of said plurality of oppositely disposed endless loop conveyor belts, in a staggered, longitudinally offset array along said conveyor belt flow path.

34. The method of conveying articles along the conveyor belt flow path as set forth claim 24, further comprising the step of:

operating said plurality of oppositely disposed conveyor belts such that said articles are able to be conveyed along said conveyor belt flow path at an enhanced rate of speed of approximately 200 inches per second (ips).

* * * * *